United States Patent [19]

Lugash

[11] 4,030,768

[45] June 21, 1977

[54] STEERABLE WHEELED GARMENT BAG

[76] Inventor: Max J. Lugash, 201 Ocean Ave., Santa Monica, Calif. 90402

[22] Filed: Nov. 17, 1975

[21] Appl. No.: 632,364

[52] U.S. Cl. ..... 280/47.17; 280/47.19; 190/18 A; 280/DIG. 3

[51] Int. Cl.[2] ..... B62B 3/00

[58] Field of Search ..... 280/79.1, DIG. 3, 47.26, 280/37, 47.17, 47.19; 190/18 A

[56] References Cited

UNITED STATES PATENTS

| | | | |
|---|---|---|---|
| 1,099,933 | 6/1914 | Pohrer | 280/47.17 |
| 1,822,893 | 9/1931 | Kapolkin | 280/DIG. 3 |
| 2,228,066 | 1/1941 | Tashbook | 280/47.17 |
| 2,313,884 | 3/1943 | Mattoon | 190/18 A |
| 2,392,926 | 1/1946 | Kelly | 280/47.17 |
| 2,463,391 | 3/1949 | Kanaley | 190/18 A |
| 2,596,578 | 5/1952 | McIntyre et al. | 190/18 A |

FOREIGN PATENTS OR APPLICATIONS

| | | | |
|---|---|---|---|
| 1,149,342 | 12/1957 | France | 280/DIG. 3 |
| 487,220 | 11/1953 | Italy | 190/18 A |
| 139,571 | 3/1953 | Sweden | 280/DIG. 3 |
| 212,352 | 3/1924 | United Kingdom | 190/18 A |

*Primary Examiner*—Robert R. Song
*Assistant Examiner*—J. D. Rubenstein
*Attorney, Agent, or Firm*—Frederick E. Mueller

[57] ABSTRACT

A soft-walled garment bag has rigid means, e.g., a central, internal post or column, interconnecting its upper and lower ends. The lower end comprises a rigid platform borne on a tandem pair of wheels that are steerable by manipulation of the upper end of the structure, e.g., via a handle fixed to the upper end of the column or post. A clothing hanger or hangers are detachably connectable to the rigid means to carry a suit or coat or the like about which the garment bag is closely fitted. The cover sheets of the garment bag are peripherally secured to the lower end of the platform and one side of the bag incorporates a carrying strap for suspending the piece of luggage under an arm from one hand in an erect position against one side of the body of the user for transportation over stairs, or in other such situations which inhibit wheel supported movement of the luggage.

6 Claims, 3 Drawing Figures

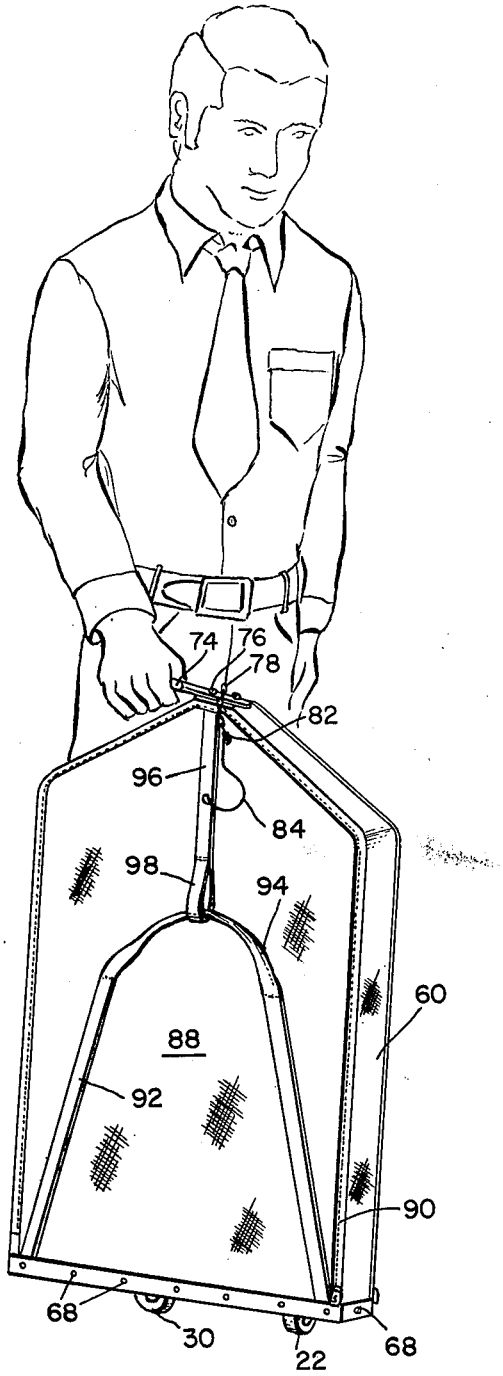
Fig. 1.
Fig. 3.
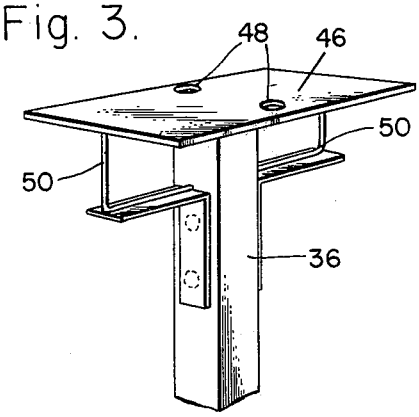
Fig. 2.
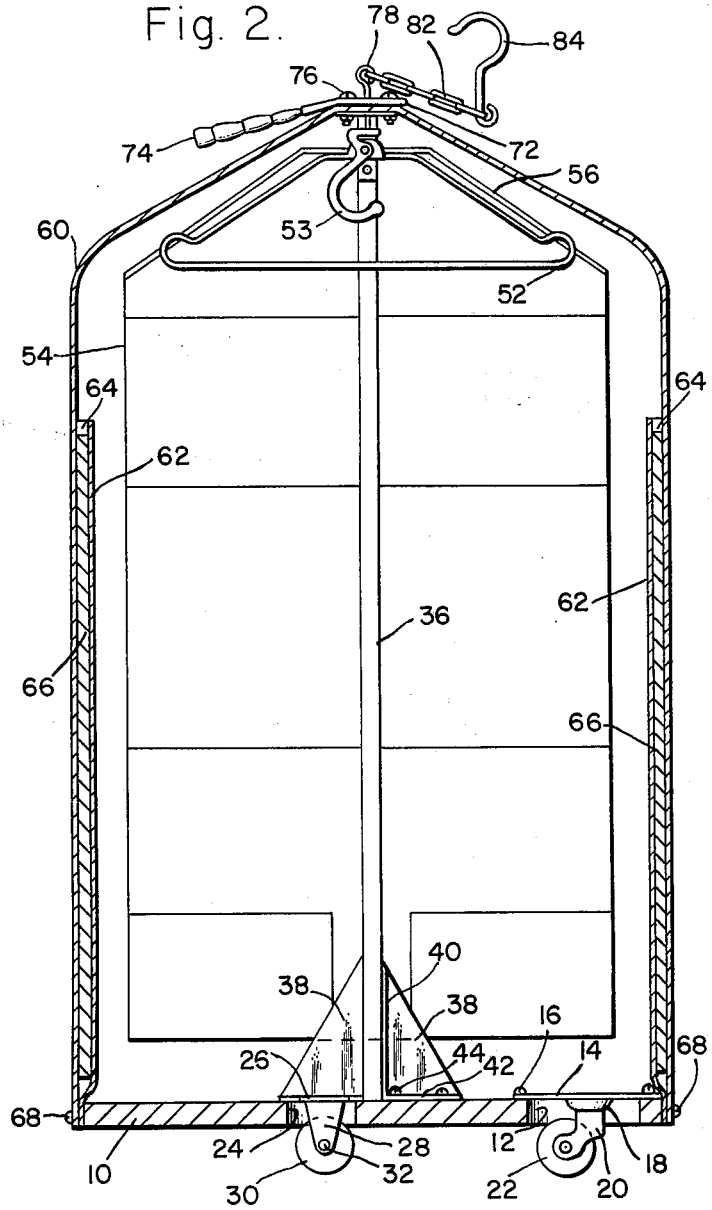

STEERABLE WHEELED GARMENT BAG

FIELD OF THE INVENTION

The present invention relates generally to hand luggage, as contrasted to relatively heavy trunks such as rigid walled cases of such bulk or weight as to typically require transportation on wheeled dollies. In particular, the present invention relates to luggage of the so called garment bag type.

BACKGROUND OF THE INVENTION

Conventional garment bags are widely used by airline passengers because of their very great convenience as carry-on luggage, in spite of the fact that they are highly inefficient as luggage. Typically, garment bags are carried either by being folded over an arm or by being slung over the shoulder and held by one hand on a hanger hook. Suit coats, trousers, shirts and the like may be suspended from individual hangers within the garment bag but sundry items such as underclothing, socks, shoes and shaving kits or gear, if carried in the garment bag instead of a separate piece of luggage, are carried loose within the bag. In spite of the great convenience of conventional garment bags as carry-on luggage they are not readily transportable by hand and, since they are not self supporting, they must always be hand or arm held, as when standing at a ticket counter, or draped over some support such as the ticket conter or the back of a chair or bench. My Pat. No. 3,448,839 discloses an improved article of hand luggage of the garment bag type which qualifies as airline carry-on luggage. In my prior invention, a rigid compartmented case or, alternatively, a compartmented bag on a rigid frame, is adapted for the reception of the smaller articles of clothing, accessories, and toilet articles and is of such area, depth and configuraton, in either case, as to fit within the confines of a suit coat. The inner frame or case has its upper end adapted to serve as a hanger for the shoulders of a suit coat or coats which then surround the frame or case so oriented that a hanger hook extends through the collar of the suit coat whereby the luggage may be hung. For hand carrying of the luggage a handle secured to the frame or case is adapted and arranged to extend through the suit coat flaps to be exteriorly available along one side of the soft-sided cover so that the luggage is carried between the arm and the side of the user, the hanger hook then extending into the armpit so that the luggage will stabilize during carrying. A zippered outer cover is provided which is of a loose fit relative to the frame or case but somewhat snugly fits over the suit coats hung therein so that, irrespective of the position or attitude of the luggage, the suit coats are securely held against displacement relative to the frame or case. The outer cover itself is provided with appropriate apertures through which the hanger hook and the handle extend. In my prior invention, the space is utilized so efficiently that all of the articles of clothing and toilet articles necessary for a long trip, e.g., about two weeks duration, can be carried without using any additional articles of luggage. However, when fully packed for a long trip, it is sometimes so heavy that when it must be carried relatively long distances, as for example from an airport parking lot to the ticket counter and thence to a satellite terminal, the expenditure of considerable energy is required. For use in such situations wheeled luggage is of course available, for example, that disclosed in Browning U.S. Pat. No. 3,606,372,in which wheeled rigid walled suitcase is provided with a retractable and extendable handle. There are also wheeled suitcases equipped with flexible tethers such as are used by some air crew members. In the analagous situation of shopping carts there are devices such as the collapsible package carrier disclosed in Mattoon U.S. Pat. No 2,313,884,in which a U-shaped frame has a spaced pair of castered wheels, the frame having a fabric bag equipped with handles for pulling the article about when it is in the unfolded condition. However, none of the previously known articles of luggage comprises a self-supporting carryon article of garment bag configuration which can be easily wheeled for long distances, or hand carried immediately adjacent to the side of the user, and moved with great ease through densely crowded situations and over all kinds of terrain and, at the same time, be securely leaned in a rest position without danger of skidding while, in every situation, maintaining all of the packed articles in securely stowed, unfolded and unwrinkled condition.

SUMMARY OF THE INVENTION

A relatively shallow garment enclosure is fitted with a rigid floor element to which a central post is rigidly secured. At the upper end, the side walls of the bag are upwardly convergent with an apex thereof secured to a plate affixed at the upper end of the central post or column. A hanger hook is exteriorly connected to the apex of the bag structure by a flexible element such as a length of chain. A generally horizontally extending steering handle is externally secured to the upper end of the central column, overlying a shoulder portion of the bag on one side of the column or post. A tandem pair or wheels is secured to the foor element, one being located in the central region of the floor on a fixed axle disposed transversely to the long dimension of the floor. The other wheel is located on that side of the central column or post oppositely from that side towards which the handle projects and has a swivel mounting. The upper end of the internal cenral post is fitted with means for detachably securing conventional coat and pants hangers thereto. A compartmented bag is also suspended from the upper end of the post constructon, of shape characteristics to fit within the confines of a suit coat. A zippered outer cover is provided of a fit to snugly cover the suit coats hung therein. The outer cover material is securely fastened to the periphery of the floor element and one large side panel is fitted with an auxiliary carrying handle at such an elevation that when the auxiliary handle is grasped the luggage is carried against one side of the body with its apex positioned in the arm pit.

DESCRIPTION OF THE DRAWINGS

FIG. 1 is a perspective view of a presently preferred embodiment of the invention illustrating one mode of use thereof.

FIG. 2 is a vertical sectional view in a plane intersecting a longitudinal dimension of the floor member of the luggage.

FIG. 3 is a partial perspective view, on a larger scale, showing details of the constructon of the cenral post of the framework assembly.

DESCRIPTION OF THE PREFERRED EMBODIMENT

Referring to FIG. 2, a floor 10 may be made of an elongate rectangular planform piece of wood, or other essentialy rigid material, and adjacent one end is formed with an opening 12 over which a sheet metal mounting plate 14, within the recess defined by the opening 12, mounts a bearing 18 swivelly or rotatably bearing a yoke 20 having a wheel 22 mounted on an axle carried between the arms of yoke 20.

Another opening 24 is formed through the floor member 10 at or near the midpoint of the longitudinal central line of the floor member. The opening 24 is covered by a sheet matal plate 26 (which may comprise a protion of a flange of a reinforcing gusset for the central post) and on its underside has a yoke 28 affixed thereto for mounting a wheel 30 on an axle 32 which is thus fixedly oriented at right angles to the longitudinal center line of the floor member 10. While the pair of wheels 22 and 30 could be mounted directly to the underside of an imperforate floor member, the illustrated manner of recessing the wheel mounts is preferred in order to reduce the overall height of the luggage carrier.

A vertically elongated post 36, e.g., a length of square tubing, has its lower end rigidly connected to the center of the surface of the foor member 10. This may readily be accomplished for example by a pair of gussets 38 integrally formed with a verticai flange 40, which may spot-welded to one face of the square tubing, and a horizontal flange 42, through which the gusset can be secured to the upper face of the floor member 10 as by means of fasteners 44.

As is shown in FIG. 3, the post 36 is capped at its upper end by a rectangular plate 46 formed with a spaced pair of holes 48 positioned along a line parallel to the longitudinal axis of the floor member 10. Along a line transverse to the line of the holes 48 the underside of the cap plate 46, on opposite sides of the post 36, is fitted with conventional inverted T-shaped elements 50 for detachably mounting conventional hangers 52 of the type illustrated in FIG. 2. A compartmented bag 54, such as is schematically illustrated in plan elevation in FIG. 2, may also be suspended from one of the T elements 50, the bag at its upper end including a rod 56 fitted with a conventional hanger clip such as the pivotable hanger clip 53 shown for the conventional hanger 52.

As is indicated in FIG. 1, the piece of luggage is relatively shallow in depth, for example on the order of 6 to 8 inches. As is shown in FIG. 2, the perimeter of the shallow luggage is defined in part by the floor member 10. The remainder of the perimeter wall may be defined by a length of rubberized or waterproof canvas or other suitable sheet material. For example, in FIG. 2 a single length of such sheet material, identified by the numeral 60, is employed. If it is desired to rigidify portions of the verticals runs of the perimeter wall a pair of rectangular pieces of sheet material 62 may have their longitudinal marginal edges secured, as by stitching, to the insides of opposite portions of the strip 60 to define a pair pockets 64, each of which receives a length of a stiff batten 66 to rigidify the corresponding portions of the perimeter wall. Opposite ends of the material 62 and corresponding ends of the pocket material pieces 62 may be rigidly fastened, as by rivets, to the opposite narrow ends of the floor member 10, as indicated at 68.

The center of the strip of material 60 is run over the top of the cap plate 46 and clamped in place thereon by a flat shank portion 72 of a handle member 74, the assembly being made by means of a pair of nut and bolt fasteners 76 which penetrate the holes 48 of the cap plate 46. The shank 72 of the handle member may also be fitted with an upwardly projecting eye member 78 having one end of a short length of chain or other flexible member 80 connected thereto, the other end of the chain being fitted with a hanger hook 84.

The large sides of the luggage may also suitably be made of pieces of a fabric material. One such side is illustrated in perspective in FIG. 1 and, while not shown, it will of course be understood that the other side is congruently shaped. Thus, each side comprises a fabric panel 88 whose lower margin is secured to one long side of the floor member 10, as by other rivets 68. The upper end of the panel 88 is formed with upwardly convergent margins and each of the side panels is connected to the corresponding margin of the peripheral wall panel 60 by slide fastener means 90. One of the large side panels, for example the panel 88 visibly in FIG. 1, has a length of sturdy fabric tape 92 secured thereto, perferably in an upwardly convergent pattern extending from opposite ends of the floor member 10, being stitched through the major portion of its length but leaving an unstitched free apex portion 94 to serve as an auxiliary or alternative carrying handle. In order to restrain the handle portion 94 from falling outwardly away from the side panel another length of heavy tape 96 may be stitched to the side wall, extending downwardly from the apex of the luggage and terminating in loop portion 98 through which the handle portion 94 passes loosely.

As will be apparent, the compartments of the bag 54 may be packed with small articles such as socks, shirts, undergarments and other sundry items, either while remaining suspended within the luggage or separately therefrom. Trousers may of course be suspended over the horizontal bar of the conventional hanger 52. Suit coats may be suspended on conventional hangers 52 or on the upwardly convergent portions of the frame 56 of the compartmented bag support. In either case, at least one of the suit coats is preferably mounted to encompass not only its supporting hanger but also the compartmented bag 54 and the center post 36 as well. In this connection, it will be noted that a clearance gap is provided between the shoulder portions of the hanger devices and the upwardly convergent portions of the peripheral side wall 60 adapted to receive the shoulder portions of the garment to be suspended within the luggage. Similarly, clearance is provided between opposite vertical edges of the compartmented bag 54 and the confronting vertically extending peripheral wall portions of the luggage to receive the hanging portions of the suit coats or other garments carried by the luggage. In any event, it will be apparent that virtually all of the internal volume of the relatively shallow luggage is employed, with a secure storage of small articles of toilet gear and clothing as well as of suit coats or the like, with the outer cover of the luggage relatively closely or snugly embracing the contents.

During packing, the luggage may be suspended by means of the hanger hook 84. After packing is completed the slide fasteners 90 may be operated to close the opposite large side panels, such as the panel 88, and the luggage then placed on a ground surface to be supported on its tandem pair of wheels 22 and 30. The handle 74 may then be grasped in the manner shown in FIG. 1 and the luggage rolled forwardly in the direction of the longitudinal axis of the floor member 10. As will be apparent, by this mode of operation the luggage, even though heavily loaded, may be moved for long distances without fatigue to the user, the weight being supported by the wheels.

The orientation of the tandem pair of wheels 22 and 30 relative to the handle 74 and the post 36 provides several advantages in transporting the luggage. For example, upon a curb or other similar obstruction being encountered the handle 74 may be pulled rearwardly to elevate the forward wheel 22 for lifting it over a curb. In such situations, it will be noted that the post 36 provides a sufficiently long lever arm to easily permit such manipulation, particularly since the fixed axle wheel 30 is located beneath or in the region of the lower end of the post 36. Alternatively, if the curb is too high to be negotiated by this mode of manipulation the luggage may be raised by means of handle 74 or, alternatively, by means of the handle strap 94.

The positions of the fixed wheel 30 and castered wheel 22 relative to the post 36 and the direction of the handle 74 provide important advantages in manipulation of the luggage. For example, in dense crowds the shallow luggage may be wheeled and precisely weaved through the crowd in very close proximity to the side of the user, who does not require any large area path of movement. Sudden and abrupt changes of direction are easily achieved within a very small radius of the user merely by turning the handle 74 left or right as indicated and thus correspondingly steering the castered wheel 22. This is to be contrasted with the difficulty in manuevering conventional wheeled luggage through crowds, due to the large area occupied by a suitcase and long handle projecting therefrom to the user and requiring a large turning radius.

Another important advantage is achieved by providing the castered mounting for the front wheel 22 and a fixed axle mounting for the central region wheel 30. Thus, when the user of the luggage is in a rest position, the hand may be removed from the handle 74 and the luggage will lean against the side of the user (or may be leaned against any stationary vertical surface) without the bottom slipping away because the axle of the central region wheel 30 is fixed at right angles to the longitudinal axis of the floor member 10.

When the bag must be carried, for example upon encountering a flight of stairs, it may be lifted by the auxiliary handle 94 with the apex of the bag tucked against the side and into the armpit of the user.

While a preferred embodiment of the luggage of this invention has been illustrated and described, it will readily be perceived that changes and modifications may be made without departing from the invention. For example, it will be appreciated that in lieu of a rigid post interconnecting the steering handle 74 and the tandem wheel mounted floor member 10, equivalent rigid means may comprise a pre-molded shallow case as depicted in FIG. 2 of my U.S. Pat. No. 3,448,839. In addition, while it is distinctly preferable to have a steering handle such as the handle 74, it will be understood that when the luggage is packed that the shoulders of the garments suspended therein, by virtue of the relatively snug fit of the outer cover thereover, may serve as means for manual manipulation in order to accomplish pushing and steering of the luggage.

I claim:

1. Wheeled hand luggage comprising:
a. a vertically elongate enclosure having top, bottom, side, front and rear walls;
b. a tanden pair of wheels mounted on said bottom wall of said enclosure;
c. rigid means connecting said top wall of said enclosure with said bottom wall of said enclosure and positioned within said enclosure;
d. means at the upper end of said rigid means for suspending garments within said enclosure;
e. one of said pair of wheels being mounted at the front portion of said bottom wall and the other of said wheels being mounted centrally on the said longitudinal axis of said bottom wall and adjacent said rigid means;
f. and said front wheel being castered about a vertical pivot and said centrally mounted wheel being non-castered.

2. Wheeled hand luggage as in claim 1 and including:
a. a lift handle secured centrally to the exterior of one of said side walls.

3. Wheeled hand luggage as in claim 2 and including:
a. means secured to said enclosure and supporting said lift handle for maintaining said lift handle against said one side wall when said lift handle is not in use.

4. Wheeled hand luggage as in claim 3 and wherein:
a. said lift handle supporting means includes a strap secured adjacent said top wall and surrounding said handle.

5. Wheeled hand luggage as in claim 1 and wherein:
a. said bottom wall includes a pair of openings and said wheels are fixed to said bottom wall inside said enclosure and
b. a pair of plates covering said openings, and
c. one of said wheels of said pair being supported by one plate and the other of said pair being supported by the other plate.

6. Wheeled hand luggage as in claim 1 and wherein:
a. said rigid means connecting said upper wall includes upper plate means;
b. said upper plate means including a guide handle secured thereto.

* * * * *